United States Patent [19]

Hirose

[11] Patent Number: 5,042,229

[45] Date of Patent: Aug. 27, 1991

[54] METHOD AND APPARATUS FOR CONTROLLING A DRIVING SYSTEM OF A PACKAGING APPARATUS

[75] Inventor: Kenichi Hirose, Koshigaya, Japan

[73] Assignee: Omori Machinery Co., Ltd., Saitama, Japan

[21] Appl. No.: 517,039

[22] Filed: May 1, 1990

[30] Foreign Application Priority Data

Jul. 20, 1989 [JP] Japan ..... 1-186084

[51] Int. Cl.[5] ..... B65B 9/06; B65B 57/14

[52] U.S. Cl. ..... 53/450; 53/504; 53/550

[58] Field of Search ..... 53/450, 550, 548, 553, 53/504, 55, 52, 66, 64

[56] References Cited

U.S. PATENT DOCUMENTS

| | | | |
|---|---|---|---|
| 3,545,165 | 12/1970 | Greenwell | 53/450 X |
| 3,973,372 | 8/1976 | Omori | 53/450 X |
| 4,514,965 | 5/1985 | Adachi et al. | 53/553 |
| 4,722,168 | 2/1988 | Heaney | 53/450 |
| 4,870,802 | 10/1989 | Cerf | 53/450 X |
| 4,909,018 | 3/1990 | Yamamoto | 53/450 |
| 4,924,657 | 5/1990 | Berti et al. | 53/450 |
| 4,947,623 | 8/1990 | Saito et al. | 53/450 X |

*Primary Examiner*—james F. Coan

*Attorney, Agent, or Firm*—Wenderoth, Lind & Ponack

[57] ABSTRACT

A driving system in a packaging appratus is controlled by detecting when an object to be packaged reaches a predetermined position of a supplying device, driving a film supplying device to withdraw a packaging film in the form of a strip for a predetermined time and/or a predetermined length after detecting the object to be packaged at the predetermined position, and driving a cutting device to cut a predetermined position of the packaging film, formed cylindrically about the object, after detecting the object to be packaged at the predetermined position. A detecting device is provided on or adjacent to the supplying device for detecting when the object to be packaged reaches the predetermined position of the supplying device. A first driving device drives the supplying device at a constant speed. A second driving device drives the film supplying device, and a third driving device drives the cutting device. A control controls the second and third driving devices in a manner such that after the detecting device detects the object to be packaged, the second and third driving devices are driven for a predetermined time and/or a predetermined amount.

25 Claims, 6 Drawing Sheets

METHOD AND APPARATUS FOR CONTROLLING A DRIVING SYSTEM OF A PACKAGING APPARATUS

BACKGROUND OF THE INVENTION

The present invention relates to a method and apparatus for controlling a driving system of a packaging apparatus, and more particularly to a method and apparatus for controlling a driving system of a packaging apparatus in which when objects to be packaged are not supplied from a supplying device to a packaging apparatus main body, the driving system is controlled in accordance with an improved response characteristic in a manner such that operation of a film supplying device and a film cutting device are interrupted, thereby temporarily to avoid forming empty packaged portions.

In general, when manufacturing packaged products by a stretch packaging apparatus, a lateral pillow packaging apparatus and the like, a packaging film in the form of a continuous strip is withdrawn from a roll of film which is made up of an elongate film would around a reel. While being withdrawn, the strip packaging film is formed into a cylindrical shape, and objects to be packaged are supplied into the cylindrical packaging film at regular intervals one after another. Next, the objects to be packaged and the cylindrical packaging film are fed forwardly by a conveying device while remaining in such state. While being conveyed, the cylindrical packaging film is cut and sealed to form packaged products. Incidentally, such stretch packaging does not require a sealing operation.

In the above conventional method and apparatus, if the objects to be packaged are orderly supplied into the cylindrical packaging film one after another, generally problems do not occur. However, when the objects to be packaged are not supplied into the cylindrical packaging film for some reason, the above conventional method and apparatus have given rise to the following problems.

That is, in the stretch packaging apparatus, since the stretch film per se constituting a packaging film is easily stretchable, a pair of endless belts are provided along with sides of the feeding path in order to stably feed the stretch film and the objects inserted in the stretch film. The feeding force is generated by holding both sides of the object to be packaged by the pair of endless belts, with the film between the object and each belt. Therefore, if the objects to be packaged are not orderly supplied at regular intervals, the feeding force is not accurately transmitted to the objects to be packaged and the stretch film. This results in a failure to feed both the objects to be packaged and the stretch film at a predetermined speed or in a stoppage of feed thereof. However, during such feed failure, the strip stretch film still is continuously withdrawn from the roll of film.

As a result, the strip stretch film is slackened or wrinkled at the position where the withdrawn strip stretch film is formed into a cylindrical shape. If the object to be packaged and the cylindrical film are fed at a lower speed than the predetermined speed, the relative positions of the front and the rear of the object are displaced from regular or planned positions thereof. This results in the cutting device erroneously cutting the object to be packaged or in either the cutting device or an end sealing device contacting and holding the object to be packaged.

On the other hand, in the pillow packaging apparatus, since the strength of the packaging film to be used is relatively high, the above problem is avoidable. However, that portion of the packaging film where an object to be packaged is not inserted becomes an empty packaged portion. This represents a waste of the packaging film.

In the conventional method and apparatus, in order to solve the above problems, a driving member such as a roller for continuously withdrawing the strip packaging film from the roll of film is connected to a driving motor through a clutch brake, and a driving member such as an endless belt for feeding the packaging film which encloses the objects to be packaged is connected to a driving motor through a clutch brake. If an object to be packaged is not supplied, such driving members are disconnected from the driving motors by the clutch brakes, and the corresponding driving members are stopped temporarily.

However, a clutch brake naturally has an inferior response characteristic, and long use of such a clutch brake causes a clutch member thereof to wear away, thereby further degrading the response characteristic. Furthermore, the use of such clutch brakes complicates the driving mechanism and increases manufacturing costs.

SUMMARY OF THE INVENTION

It is an object of the present invention to provide a method and apparatus for controlling a driving system of a packaging apparatus in which when objects to be packaged are not supplied from a supplying device to a packaging apparatus main body, the driving system is controlled in accordance with an improved response characteristic in a manner such that operation of a film supplying device and a film cutting device temporarily are interrupted, thereby avoiding the formation of empty packaged portions and thus ensuring that the objects to be packaged and the packaging film are fed in a stable manner and that the packaging work operations will be performed reliably.

Another object of the present invention is to provide an apparatus for controlling a driving system of a packaging apparatus which has a simple structure and can be manufactured at low cost.

According to a first aspect of the present invention, there is provided a method for controlling a driving system for use in a packaging apparatus comprising a packaging apparatus main body for forming a packaging film in the form of a strip into a cylindrical-shape to enclose therein an object to be packaged, feeding the object to be packaged to a position accommodated in the cylindrical packaging film and cutting a predetermined position of the cylindrical packaging film by cutting means to form a packaged object while it is being fed. Supplying means conveys the object to be packaged to the packaging apparatus main body. Film supplying means supplies the packaging film in the form of a strip to the packaging apparatus main body so as to enclose the object to be packaged which is fed to the packaging apparatus main body. The method comprises the steps of detecting when the object to be packaged reaches a predetermined position of the supplying means while driving the supplying means at a constant speed, driving the film supplying means to withdraw the packaging film in the form of a strip for a predetermined time and/or a predetermined amount after detecting the object to be packaged at the predetermined position, and driving the cutting means in the packaging apparatus main body to form the packaged object for a predetermined time and/or a predetermined amount after detecting the object to be packaged at the predetermined position.

According to a second aspect of the present invention, there is provided an apparatus for controlling a driving system for use in a packaging apparatus comprising a packaging apparatus main body for forming a packaging film in the form of a strip into a cylindrical-shape to enclose therein an object to be packaged, feeding the object to be packaged to a position accommodated in the cylindrical packaging film and cutting a predetermined position of the cylindrical packaging film by cutting means to form a packaged object while it is being fed, supplying means for conveying the object to be packaged and supplying the same to the packaging apparatus main body and film supplying means for supplying the packaging film in the form of a strip to the packaging apparatus main body so as to enclose the object to be packaged which is fed to the packaging apparatus main body. The controlling apparatus comprises detecting means provided on or adjacent to the supplying means for detecting when the object to be packaged reaches a predetermined position of the supplying means, first driving means for driving the supplying means at a constant speed, second driving means for driving the film supplying means, third driving means for driving the cutting means, and controlling means for controlling the second and third driving means in a manner such that after the detecting means detects the object to be packaged, the second and third driving means are driven for a predetermined time and/or a predetermined amount.

With the above structure, when a start button is depressed, the first driving means is driven to drive the supplying means at a constant speed, and the objects to be packaged are fed at regular intervals and supplied to the packaging apparatus main body one after another. On the other hand, the second and third driving means are driven intermittently in synchronization with signals from the detecting means. When the objects to be packaged are not orderly conveyed at regular intervals such that objects are missing at some places on the supplying means, the second and third driving means remain immobile because the detecting means does not detect the objects to be packaged. In other words, when objects to be packaged are not conveyed, the strip packaging film is not supplied to the packaging apparatus main body and the cutting means is not actuated. As a result, even if the objects to be packaged are not conveyed on the supplying means at regular intervals, the objects to be packaged are always fed in the packaging apparatus main body at regular intervals. Therefore, without the use of clutch brakes, the driving system is controlled with highly improved response characteristics when objects to be packaged are not supplied.

The above and other objects, features and advantages of the present invention will become apparent from the following description when taken in conjunction with the accompanying drawings in which preferred embodiments of the present invention are shown by way of illustrative examples.

DETAILED DESCRIPTION OF THE PREFERRED EMBODIMENTS

Figure 1:
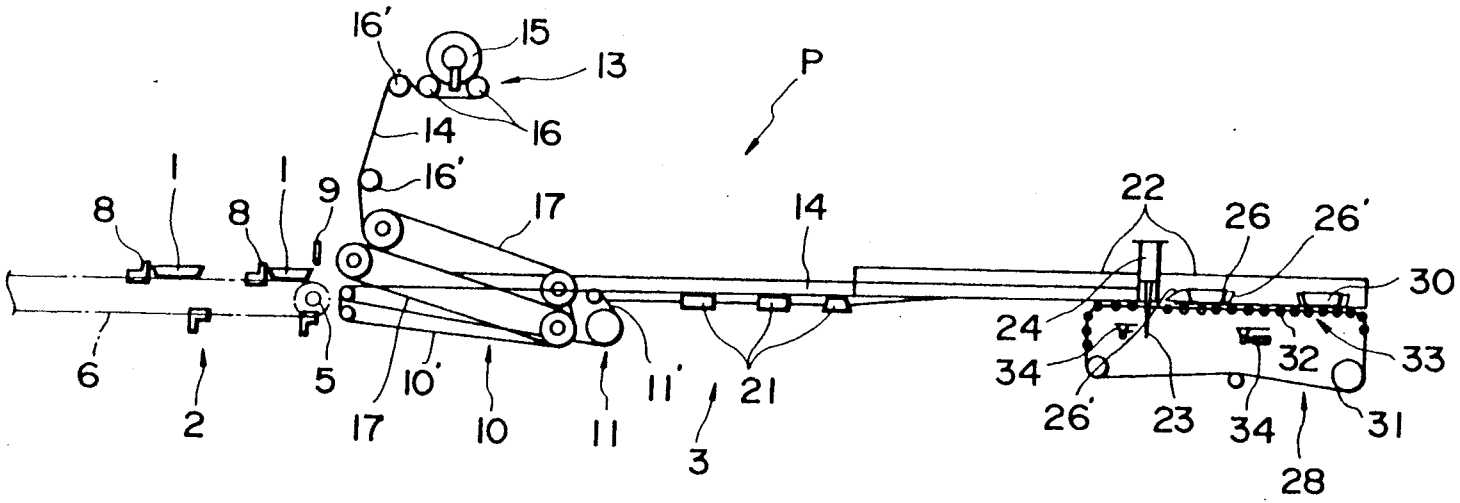
FIG. 1 is a schematic cross-sectional view of an apparatus for controlling a driving system of a packaging apparatus according to a first embodiment of the present invention.

A method and apparatus for controlling a driving system of a packaging apparatus according to a first embodiment of the present invention will be described below with reference to FIGS. 1 through 3.

First, a mechanical structure of a packaging apparatus P will be described with reference to FIGS. 1 and 2.

The packaging apparatus P comprises a supplying device 2 for feeding objects 1 to be packaged at regular intervals, and a packaging apparatus main body 3 provided in the vicinity of a discharge end of the supplying device 2. In this embodiment, the object 1 to be packaged comprises a tray accommodating an article or articles.

Figure 2:
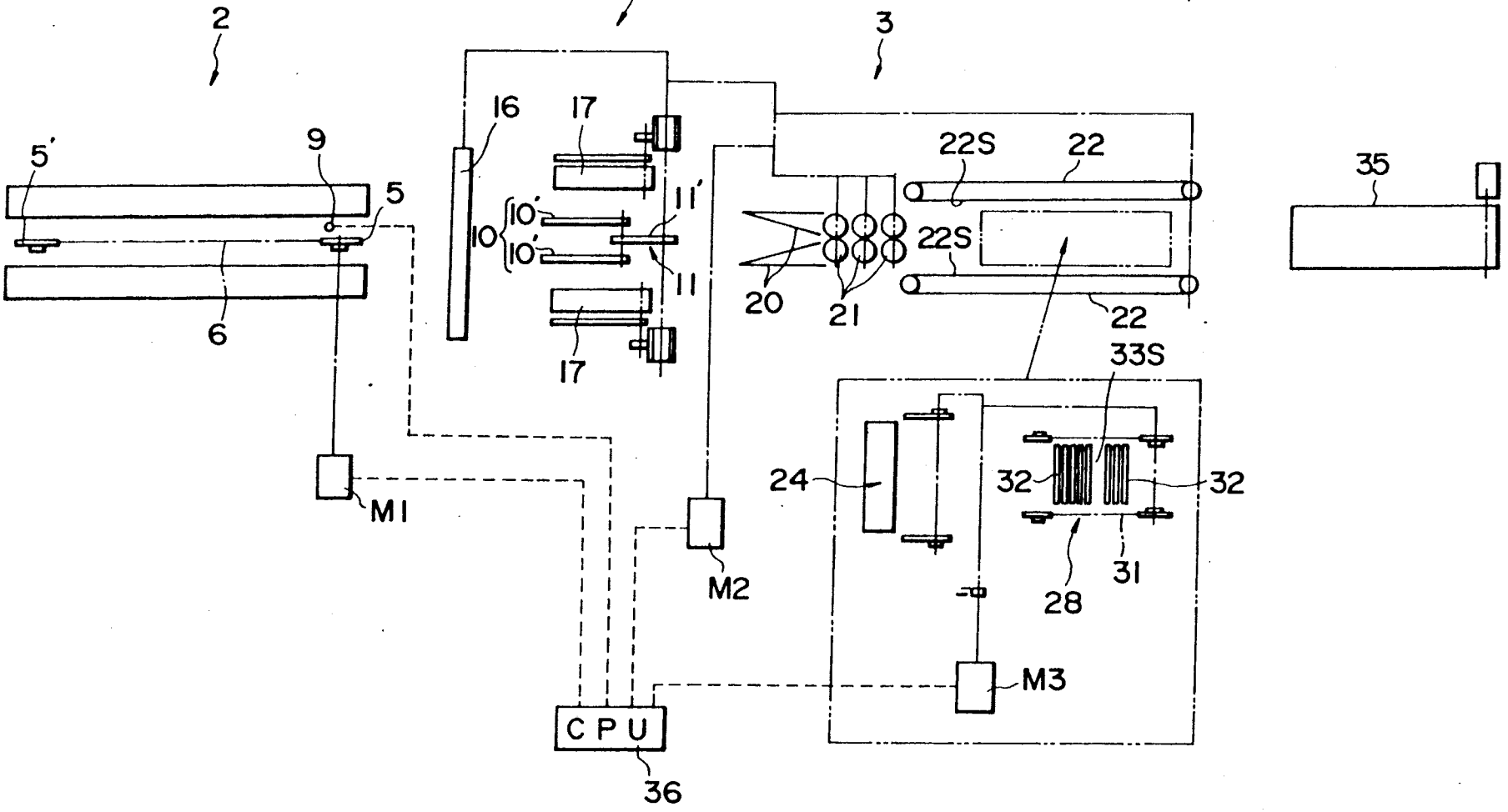
FIG. 2 is a schematic plan view of the apparatus for controlling a driving system of a packaging apparatus according to the first embodiment of the present invention.

The supplying device 2 comprises a pair of sprockets 5, 5', an endless chain 6 provided between the sprockets 5, 5', and a plurality of fingers 8 provided on the endless chain 6 at regular intervals as shown in FIGS. 1 and 2. The sprocket 5 is connected to a first driving motor M1. When the sprocket 5 is rotated by the first driving motor M1, the endless chain 6 travels and the fingers 8 on the chain 6 move forward toward the packaging apparatus main body 3. In this embodiment, the first driving motor M1 rotates at a constant speed.

At the discharge end of the supplying device 2 is provided a vertical photoelectric tube 9 constituting a detecting means. The photoelectric tube 9 is a transmission type photoelectric tube, and it detects whether an object 1 to be packaged has passed a given position of supplying device 2.

The packaging apparatus main body 3 has a first lower side feeding device 10 which comprises a pair of endless belts 10', 10' provided at an inlet end or side thereof and juxtaposed to extend along the travelling direction of the object 1 to be packaged. The packaging apparatus also has a second lower side feeding device 11 which comprises an endless belt 11' positioned adjacent to a forward end portion of the first lower side feeding device 10 and interposed between the endless belts 10', 10'. The feeding paths of both of the lower side feeding devices 10, 11 are arranged on approximately the same plane as that of the supplying device 2, and the object 1 to be packaged supplied from the supplying device 2 is transferred onto the lower side feeding devices 10, 11 and is fed forwardly by the lower side feeding devices 10, 11.

A film supplying device 13 is provided above the lower side feeding device 10. The film supplying device 13 comprises a roll of film 15 which is made up of an elongate packaging film 14 wound around a reel, feed rollers 16 provided immediately below the roll of film 15 and a plurality of guide rollers 16'. The packaging film 14 such as a stretch film is in the form of a continuous strip that is continuously taken out of or withdrawn from the roll of film 15 and fed by the feed rollers 16 and the guide rollers 16'.

On the other hand, on each of opposite sides of the first and second lower side feeding devices 10, 11, there is provided a pair of film holding belts 17, each having a wide width, which are arranged one above the other so that they tough each other. Opposite surfaces of the withdrawn strip packaging film 14 are sandwiched between the film holding belts 17, and the strip packaging film 14 is fed forwardly thereby.

Further, downstream of the first and second lower side feeding devices 10, 11, there are provided a pair of guide plates 20 by which the strip packaging film 14 is formed into a cylindrical shape so as to enclose therein the object 1 to be packaged. A plurality of pairs of pressing rollers 21 are provided immediately downstream of the guide plates 20. A joined portion at the lower end of the packaging film 14 now in the form of a cylinder is pressed by the pressing rollers 21 so that the joined portion self-adheres.

Furthermore, at the downstream side of the pressing rollers 21, two product feeding belts 22 constituting feeding means are juxtapositionally provided in a manner such that belt surfaces 22*s* of the two belts are positioned in vertical planes. Opposite sides of the object 1 to be packaged are sandwiched between the two belt surfaces 22*s*, aligned in confrontation with each other, of the product feeding belts 22. The object 1 and the surrounding cylindrical packaging film 14 are fed by movement of the product feeding belts 22.

The first and second lower feeding devices 10, 11, the feed rollers 16, and the pressing rollers 21 are connected to a second driving motor M2 through various power transmission means.

On the other hand, between the two produce feeding belts 22 and at a position intermediate the length thereof, there is provided a cutting device 24 having a cutter 23 which is movable vertically. The cutting device 24 serves to form an intermediate packaged product 26 by cutting the portion of the film positioned between two adjacent objects 1 which are enclosed by the cylindrical packaging film 14.

Further, a folding device 28 is provided at the discharge end of the cutting device 24 and between the product feeding belts 22. The cutting device 24 and the folding device 28 are connected to a third driving motor M3 through various transmission means. The folding device 28 serves to fold front and rear edges 26' of the intermediate packaged product 26 towards the bottom thereof, thereby resulting in a finished packaged product 30. The folding device 28 comprises two spaced endless chains 31, a plurality of cylindrical rollers 32 provided between the endless chains 31, and suction nozzles 34, for attracting the edges 26' downwardly, located below a feeding path 33 defined by the cylindrical rollers 32. The feeding path 33 has free spaces 33S, at predetermined intervals, which are formed by the absence of the cylindrical rollers 32. The travelling speed of the endless chains 31 is greater than that of the product feeding belts 22 so that the edges 26' are pulled into spaces 33S and folded downwardly by this speed difference and by the suction pressure of the suction nozzles 34. A discharge conveyor 35 is provided downstream of the product feeding belts 22 to convey the finished packaged products 30 outside the packaging apparatus P.

The photoelectric tube 9 and the first, second and third motors M1, M2, M3 are connected to a central processing unit (CPU) 36, thereby operating the respective motors M1, M2, M3 in accordance with signals from the photoelectric tube 9.

Operation of the packaging apparatus P thus constructed will be briefly described below.

The objects 1 to be packaged are supplied to the first and second lower side feeding devices 10, 11 of the packaging apparatus main body 3 one after another by the supplying device 2. On the other hand, the packaging film 14 in the form of a strip is taken out of the roll of film 15 and fed to the packaging apparatus main body 3 by the feed rollers 16 and the guide rollers 16'. In the packaging apparatus main body 3, the strip packaging film 14 is formed into a cylindrical shape by the guide plates 20 and each object 1 to be packaged is covered with the cylindrical packaging film 14. The joined portion at lower end of the cylindrical packaging film 14 is pressed by the pressing rollers 21 so that the joined portion self-adheres. Thereafter the objects 1 enclosed by the cylindrical packaging film 14 are fed forwardly. While the objects 1 to be packaged are fed by the product feeding belts 22, the intermediate portion of the cylindrical packaging film 14 between two adjacent objects 1 is cut by the cutting device 24 in a direction perpendicular to the travelling direction to form the intermediate packaged products 26. Then the edges 26' of each intermediate packaged product 26 are folded by the folding device 28 to form the finished packaged product 30.

Next, a method and apparatus for controlling the driving system of such packaging apparatus will be described below with reference to FIGS. 1 through 3.

In the present invention, timing of driving of various of the above described devices (that is, rotational speed and rotation timing of various motors M1, M2, M3) is set in the following manner.

First, the rotational speed (number of packaged products manufactured per minute) of the fingers 8 and the size of the object 1 to be packaged (a tray accommodating an article or articles in this embodiment) are input into the CPU 36 as an initial setting. In the CPU 36, a cutting measurement (the length between cuts of the packaging film 14) is calculated on the basis of the input tray size. This calculation is computed by adding two times the length of an edge 26' to the length of the tray.

Next, when an initial setting button is depressed, the first and third driving motors M1, M3 are rotated by a predetermined amount so that the relative positions of the fingers 8 and the cutter 23 are the most suitable as computed by the CPU 36 on the basis of initial data (rotational speed and cutting measurement). Incidentally, the cutter 23 is movable along the feeding direction of the object 1 by driving the motor M3.

In such a state, when a start button is depressed, the first driving motor M1 rotates at a certain speed in order to obtain the rotational speed of the fingers 8 input into the CPU 36. Thereafter, the objects 1 to be packaged are fed at regular intervals corresponding to distances between the fingers 8 and are supplied to the packaging apparatus main body 3 one after another.

On the other hand, the second and third driving motors M2, M3 rotate intermittently in synchronization with signals from the photoelectric tube 9. To be more specific, when the photoelectric tube 9 detects an object 1 to be packaged, a timer begins to clock. After a certain time elapses, both of the driving motors M2, M3 begin to rotate and increase their rotational speed gradually, and then reach a predetermined rotational speed, whereafter both of the driving motors M2, M3 continue to rotate at a constant speed while maintaining the predetermined rotational speed. Thereafter, the driving motors M2, M3 decrease their rotational speed gradually and stop. A control diagram of motors M2, M3 is shown in FIG. 3. In FIG. 3, the horizontal axis represents time T and the vertical axis represents the rotational speed of the driving motors M2, M3. Times $T_2$, $T_3$, which are the rotational times of the driving motors M2, M3, respectively, are compared with the time $T_1$ which is the time for a finger 8 to move for one pitch. The times $T_2$, $T_3$ are controlled so that they are less than or equal to the time $T_1$.

According to the above-mentioned method, if the objects 1 to be packaged are not conveyed in an orderly fashion at regular intervals and objects are not present at some fingers 8, the second and third driving motors M2, M3 will remain immobile for such intervals because the photoelectric tube 9 does not detect the presence of objects 1 to be packaged. However, when the photoelectric tube 9 detects an object 1 to be packaged, the second and third driving motors M2, M3 begin to rotate. In other words, when objects 1 to be packaged are not conveyed, the strip packaging film is not taken out of the roll of film 15, and the product feeding belts 22 and the cutting device 24 remain immobile.

As a result, even if the objects 1 to be packaged are not conveyed from the supplying device 2 at regular intervals, the objects 1 to be packaged are always fed in the packaging apparatus main body 3 at regular intervals. Therefore, the feeding force can be reliably transmitted to the objects 1 to be packaged by the product feeding belts 22, and response characteristics also can be improved because of the lack of need for provision of a clutch brake.

In this embodiment, since the time of rotation of the second and third driving motors M2, M3 is adjusted to be equal to or less than that of the first driving motor M1, the objects 1 to be packaged are prevented from being cut by the cutting device 24 or from engaging with the cutting device 24. Further, if the second and third driving motors M2, M3 are controlled so as to stop for a certain time, the chance of engagement of an object 1 with the cutting device 24 can be reduced and speed adjustment of the second and third driving motors M2, M3 can be facilitated.

A method and apparatus for controlling a driving system of a packaging apparatus according to a second embodiment of the present invention will be described below with reference to FIG. 4.

Figure 3:
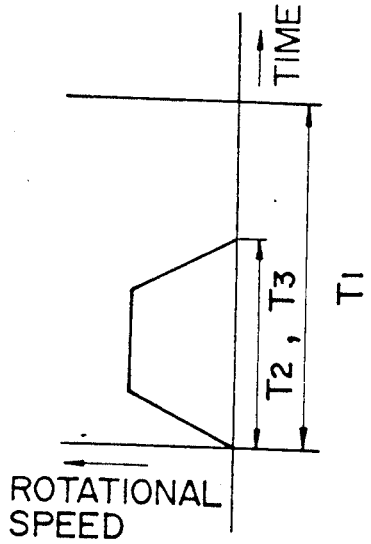
FIG. 3 is an explanatory graph showing operation of the driving system according to the first embodiment of the present invention.
Figure 4:
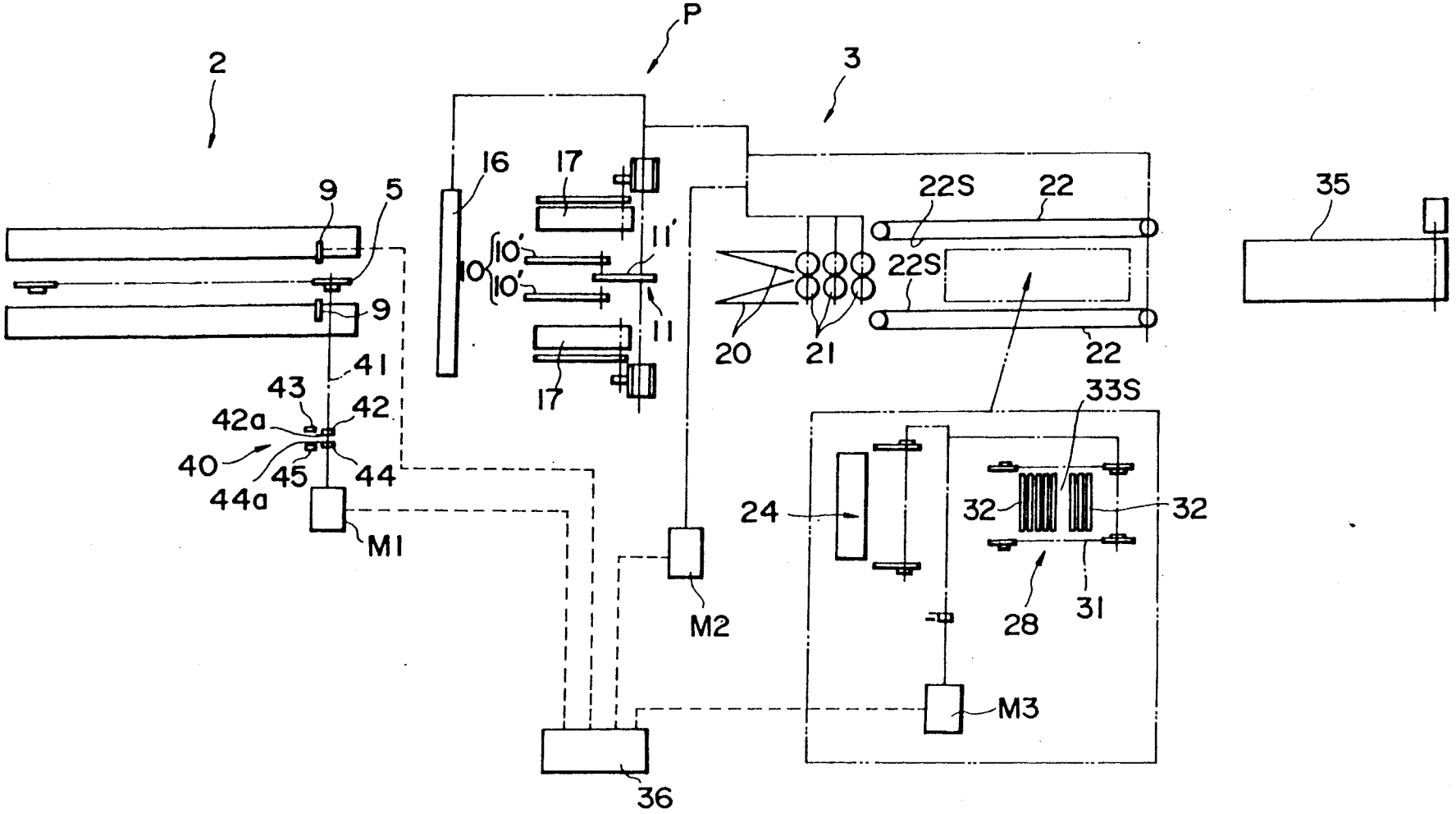
FIG. 4 is a schematic plan view of the apparatus for controlling a driving system of a packaging apparatus according to a second embodiment of the present invention.

Those parts shown in FIG. 4 which are structurally and functionally identical to those shown in FIGS. 1 through 3 are denoted by identical reference numerals.

Figure 5:
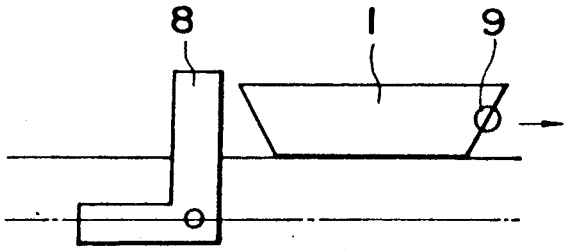
FIGS. 5(*a*)–5(*d*) are schematic views showing operation of the driving system according to the second embodiment of the present invention.
Figure 5:
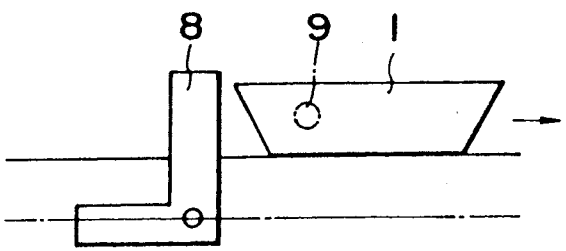
Figure 5:
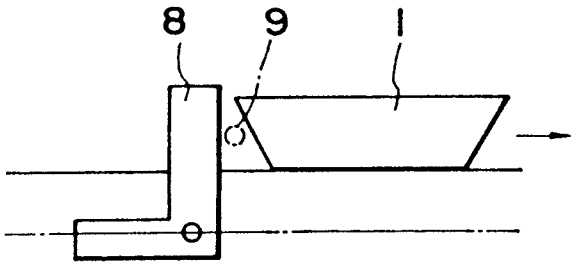
Figure 5:
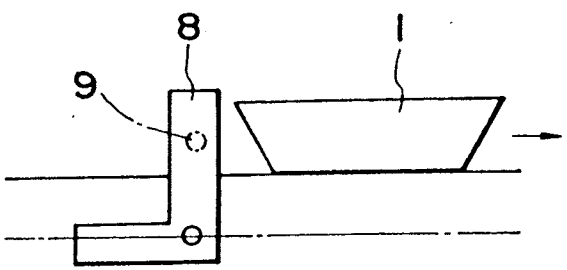

In this embodiment, at the discharge end of the supplying device 2 are provided horizontal photoelectric tubes 9 constituting detecting means. When a photoelectric tube 9 is positioned horizontally, as time elapses the photoelectric tube 9 first detects the forward end portion of an object 1 to be packaged, as shown in FIG. 5(*a*). Then the photoelectric tube 9 continues to detect the object 1 which is now passing by the tube 9 as shown in FIG. 5(*b*) until the rear end of the object 1 to be packaged passes by the tube 9. During this passage the photoelectric tube 9 transmits to the CPU 36 a signal representing the fact that the object 1 is passing. Immediately after the rear end of the object 1 to be packaged passes by the photoelectric tube 9 as shown in FIG. 5(*c*), a finger 8 reaches and passes the photoelectric tube 9 as shown in FIG. 5(*d*). Since the photoelectric tube 9 only detects the passage of an article or member and transmits a signal representative of such passage to the CPU 36, it cannot judge whether the passing article is an object 1 to be packaged or a finger 8. Accordingly, judging means 40 for judging whether the passing article is an object 1 to be packaged or a finger 8 is provided as shown in FIG. 4. In this embodiment, the judging means 40 comprises a constant position cam 42 provided on a rotating shaft 41 which interconnects the first driving motor M1 and the sprocket 5. The constant position cam 42 is provided with a projecting portion 42*a* which projects radially outwardly from a certain position of an outer periphery of a disk-shaped base plate. A proximity switch 43 is provided in the vicinity of the constant position cam 42 to detect the projecting portion 42*a*. The timing when the projecting portion 42*a* is positioned at the proximity switch 43 is adjusted to be in synchronization with the timing when a finger 8 is positioned at the photoelectric tube 9. While the projecting portion 42*a* is detected by the proximity switch 43, even if a detecting signal from the photoelectric tube 9 is generated and transmitted to the CPU 36, such detecting signal is ignored. Therefore, only a signal representative of the presence of an object 1 to be packaged will be recognized by the CPU 36.

Further, in this embodiment, a starting cam 44 is also provided on the rotating shaft 41. The starting cam 44 is provided with a projecting portion 44*a*, and a proximity switch 45 is provided in the vicinity of the starting cam 44 to detect the projecting portion 44*a*. The signal from the starting cam 44 (that is, the proximity switch 45) and the signal from the photoelectric tube 9 are input into an AND circuit in the CPU 36. The AND circuit outputs an output signal only when both signals from the proximity switch 45 and the photelectric tube 9 are input into the AND circuit. While the photoelectric tube 9 continues to detect the object 1 to be packaged from the forward end to the rear end thereof, the signal from the proximity switch 45 is generated therefore, after the object 1 to be packaged is detected by the photoelectric tube 9, the timing of the starting of the second and third driving motors M2, M3 is controlled by the AND circuit. That is, when the output signal is generated from the AND circuit, the second and third motors M2, M3 begin to rotate.

As is apparent from the above description, in the second embodiment, the detecting means and the timing of the starting of the second and third motors M2, M3 are different from those of the first embodiment. However, other aspects of the structure and operation are identical to those of the first embodiment. Therefore, description of such other aspects of the structure and operation will be omitted.

Figure 6:
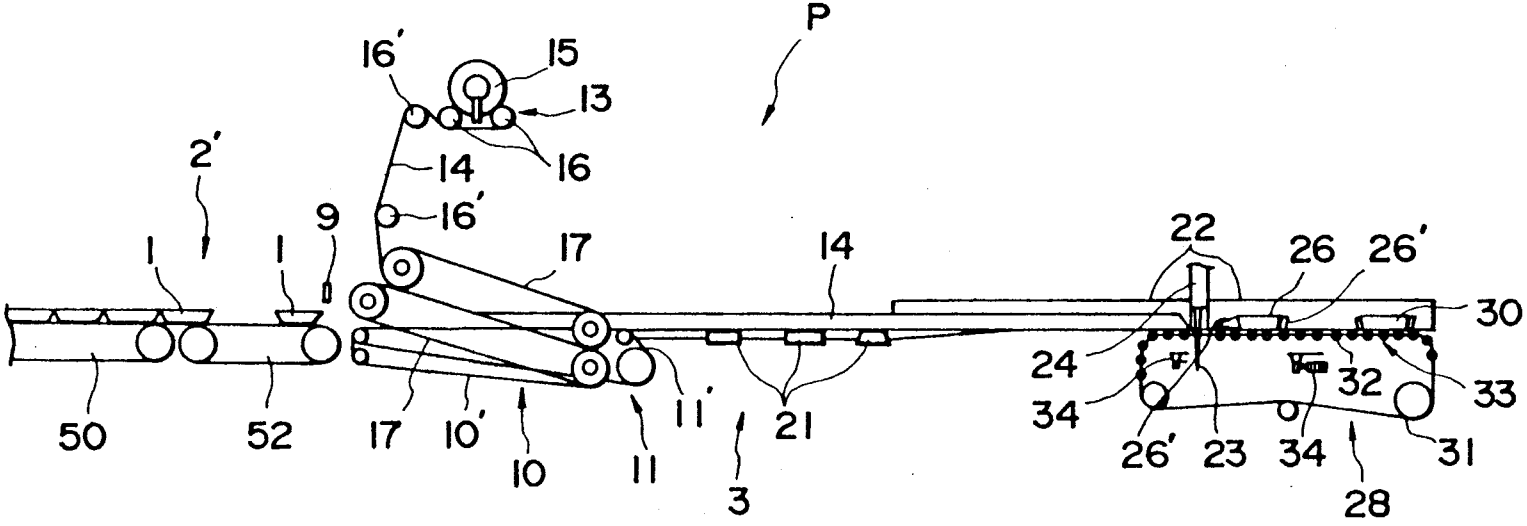
FIG. 6 is a schematic cross-sectional view of an apparatus for controlling a driving system of a packaging apparatus according to a third embodiment of the present invention.
Figure 7:
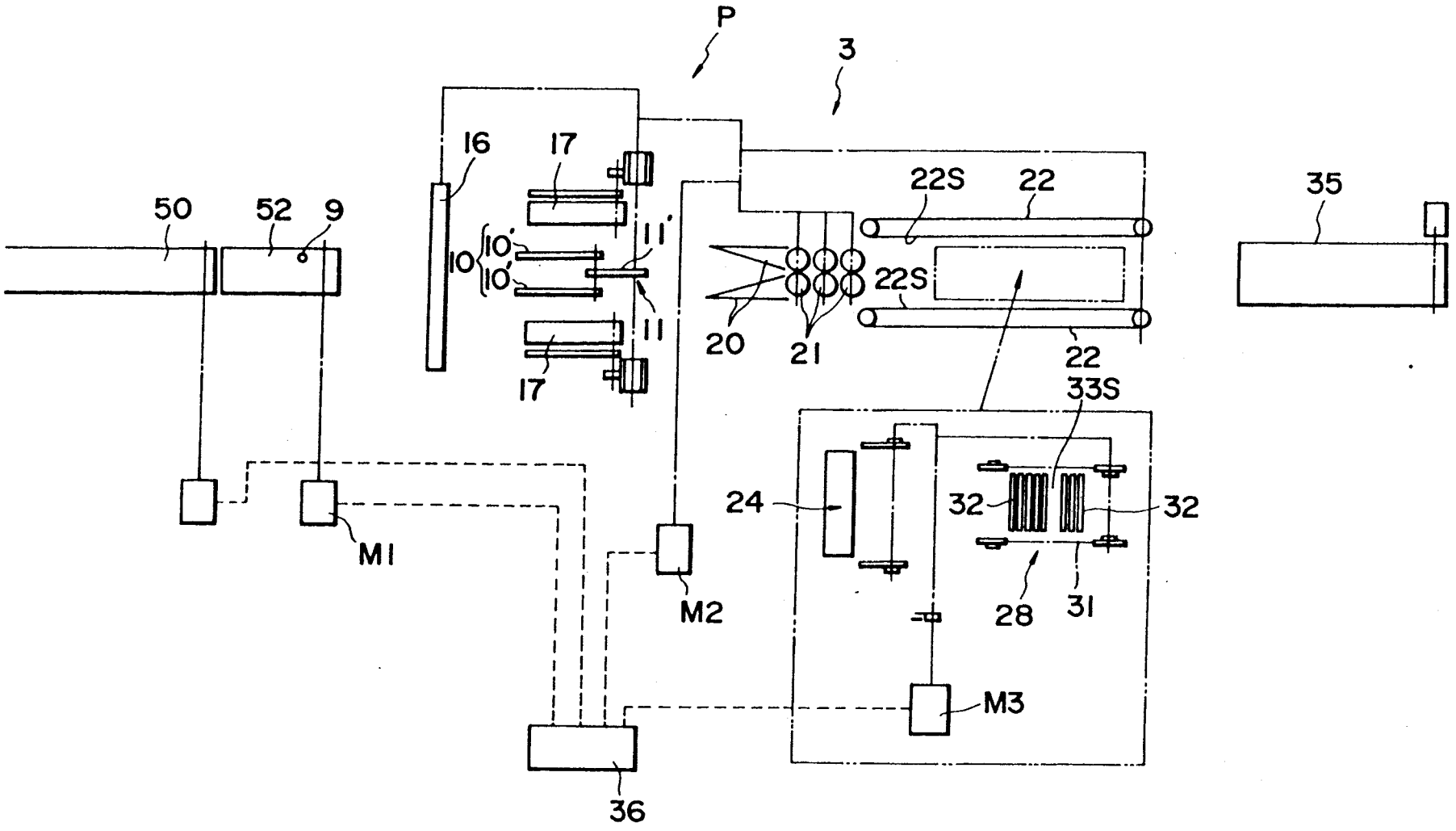
FIG. 7 is a schematic plan view of the apparatus for controlling a driving system of a packaging apparatus according to the third embodiment of the present invention.

FIGS. 6 and 7 show a third embodiment according to the present invention. In this embodiment, only a supplying device 2' is different from that of the first and second embodiments.

The supplying device 2' comprises a first conveyer belt 60 which rotates at a relatively low speed and a second conveyer belt 52 which is disposed downstream of the first conveyer belt 50 and rotates at a relatively high speed. Both conveying surfaces of the first and second conveyer belts 50, 52 are arranged on approximately the same plane. On the first conveyer belt 50, a plurality of objects 1 to be packaged are conveyed in a manner such that a preceding object 1 to be packaged and a following object 1 to be packaged are in contact with each other. As soon as the preceding object 1 to be packaged is transferred to the second conveyer belt 50, the transferred object 1 to be packaged is separated from the following object 1 to be packaged due to the difference in speed between conveyer belts 50, 52. The ratio of speeds of the two conveyer belts 50, 52 is adjusted in a manner such that when the preceding object 1 to be packaged reaches the photoelectric tube 9, there is a predetermined distance between the preceding object 1 to be packaged and the following object 1 to be packaged. According to the above structure, stretch packaging can be entirely automated. Since other aspects of the structure and operation are identical to those of the first embodiment, description thereof will be omitted.

Further, in this embodiment, although the photoelectric tube 9 is disposed in vertically, it may be disposed horizontally.

In the above embodiments, the application of the present invention to a stretch packaging apparatus is explained. However, the present invention is not limited to use with a stretch packaging apparatus. For example, the present invention is applicable to a pillow packaging apparatus or any other packaging apparatus. In the case of a pillow packaging apparatus, the present invention is helpful to avoid forming empty packaged portions.

In the case of a well-known packaging apparatus functioning to seal four sides, the film supplying means serves to pull out two strip packaging films continuously and to join such two strip packaging films so that an object 1 to be packaged is accommodated between such two packaging films. It should be noted that the present invention is applicable to those types of film supply wherein the two strip packaging film are removed from two rolls of film provided independently of each other or two strip packaging film are formed by cutting one strip packaging film removed from a single roll of film.

As is apparent from the above description, according to the present invention, since the supply of the packaging film and the feed of the objects to be packaged are controlled by rotating or stopping motors without using clutch brakes, the driving system is controlled with highly improved response characteristics when objects to be packaged are not supplied.

Further, since the driving system is of a simple structure, the overall packaging apparatus may be compact and can be manufactured at a low cost.

Although certain preferred embodiments have been shown and described, it should be understood that many changes and modifications may be made thereto without departing from the scope of the appended claims.

What is claimed is:

1. A method for controlling a driving system in a packaging apparatus including a main body, feed means for conveying objects to be packaged and supplying said objects to said main body, film supply means for supplying a continuous strip of film to said main body and advancing the film along said main body, said main body having means for forming said film strip into a tubular shape within which said objects are enclosed and are fed therewith, and means for cutting said tubular film at predetermined positions between adjacent said objects to thereby form individual packaged products, said method comprising the steps of:

driving said feed means at a constant speed;

detecting the presence of each said object at a predetermined point on said feed means;

operating said film supply means for a predetermined period of time only each time the presence of an object is detected; and operating said cutting means for a predetermined period of time only each time the presence of an object is detected.

2. A method for controlling a driving system in a packaging apparatus as claimed in claim 1, wherein the packaging apparatus further includes means for folding front and rear edges of the tubular film of each of the individual packaged products, and wherein said method further comprises the step of operating said folding means for a predetermined period of time only each time the presence of an object is detected.

3. A method for controlling a driving system in a packaging apparatus as claimed in claim 1, wherein said operating said film supply means and said operating said cutting means commence at a delayed timing after the presence of an object is detected.

4. A method for controlling a driving system in a packaging apparatus as claimed in claim 1, wherein said period of time during which said film supply means is operated is substantially equal to said period of time during which said cutting means is operated.

5. A method for controlling a driving system in a packaging apparatus as claimed in claim 1, wherein said feed means comprises a plurality of fingers arranged at regular spaced intervals for conveying respective said objects, and wherein said periods of time during which said film supply means and said cutting means are operated are controlled to be substantially equal to a period of time during which each finger moves a distance corresponding to one said interval.

6. A method for controlling a driving system in a packaging apparatus as claimed in claim 1, wherein said feed means comprises a plurality of fingers arranged at regular spaced intervals for conveying respective said objects, and wherein said periods of time during which said film supply means and said cutting means are operated are controlled to be less than a period of time during which each finger moves a distance corresponding to one said interval.

7. A method for controlling a driving system in a packaging apparatus including a main body, feed means for conveying objects to be packaged and supplying said objects to said main body, film supply means for supplying a pair of continuous strips of film to said main body and advancing the film strips along said main body, said main body having means for sealing said pair of film strips together at opposite longitudinal edges to form a film tube within which said objects are enclosed and are fed therewith, and means for cutting said film tube at predetermined positions between adjacent said objects to thereby form individual packaged products, said method comprising the steps of:

driving said feed means at a constant speed;

detecting the presence of each said object at a predetermined point on said feed means;

operating said film supply means for a predetermined period of time only each time the presence of an object is detected; and operating said cutting means for a predetermined period of time only each time the presence of an object is detected.

8. A method for controlling a driving system in a packaging apparatus as claimed in claim 7, wherein the packaging apparatus further includes means for folding front and rear edges of the film tube of each of the individual packaged products, and wherein said method further comprises the step of operating said folding means for a predetermined period of time only each time the presence of an object is detected.

9. A method for controlling a driving system in a packaging apparatus as claimed in claim 7, wherein said operating said film supply means and said operating said cutting means commence at a delayed timing after the presence of an object is detected.

10. A method for controlling a driving system in a packaging apparatus as claimed in claim 7, wherein said period of time during which said film supply means is operated is substantially equal to said period of time during which said cutting means is operated.

11. A method for controlling a driving system in a packaging apparatus as claimed in claim 7, wherein said feed means comprises a plurality of fingers arranged at regular spaced intervals for conveying respective said objects, and wherein said periods of time during which said film supply means and said cutting means are operated are controlled to be substantially equal to a period of time during which each finger moves a distance corresponding to one said interval.

12. A method for controlling a driving system in a packaging apparatus as claimed in claim 7, wherein said feed means comprises a plurality of fingers arranged at regular spaced intervals for conveying respective said objects, and wherein said periods of time during which said film supply means and said cutting means are operated are controlled to be less than a period of time during which each finger moves a distance corresponding to one said interval.

13. A driving system in a packaging apparatus including a main body, feed means for conveying objects to be packaged and supplying the objects to said main body, and film supply means for supplying a continuous strip of film to said main body and advancing the film along said main body, said main body having means for forming the film strip into a tubular shape within which the objects are enclosed and are fed therewith, and means for cutting the tubular film at predetermined positions between adjacent of the objects to thereby form individual packaged products, said driving system comprising:

a first driving motor for driving said feed means at a constant speed;

a second driving motor for driving said film supply means;

a third driving motor for driving said cutting means;

detecting means provided adjacent said feed means for detecting the presence of each of the objects at a predetermined point on said feed means; and control means, connected to said first, second and third driving motors and to said detecting means, for controlling said second and third driving motors in such a manner that said second and third driving motors are operated for predetermined periods of time only each time said detecting means detects the presence of an object.

14. A driving system in a packaging apparatus as claimed in claim 13, wherein said packaging apparatus further includes means for folding front and rear edges of the tubular film of each of the individual packaged products, and wherein said folding means is operated by said third driving motor.

15. A driving system is a packaging apparatus as claimed in claim 13, wherein said control means includes means for commencing operation of said second and third driving motors at a delayed timing after the presence of an object is detected.

16. A driving system in a packaging apparatus as claimed in claim 13, wherein said feed means comprises a plurality of fingers arranged at regular spaced intervals for conveying respective objects, and wherein said periods of time during which said second and third drive motors are operated is controlled by said control means to be substantially equal to a period of time during which each said finger moves a distance corresponding to one said interval.

17. A driving system in a packaging apparatus as claimed in claim 13, wherein said feed means comprises a plurality of fingers arranged at regular spaced intervals for conveying respective objects, and wherein said periods of time during which said second and third drive motors are operated is controlled by said control means to be less than a period of time during which each said finger moves a distance corresponding to one said interval.

18. A drive system in a packaging apparatus as claimed in claim 17, further comprising judging means for determining whether a member detected by said detecting means is an object to be packaged or one of said fingers.

19. A drive system in a packaging apparatus as claimed in claim 13, wherein said feed means comprises a first conveyer belt moving at a relatively low speed, and a second conveyer belt disposed adjacent a downstream end of said first conveyer belt and moving at a relatively high speed.

20. A driving system adapted to be used in a packaging apparatus including a main body, feed means for conveying objects to be packaged and supplying the objects to the main body, film supply means for supplying a continuous strip of film to the main body and advancing the film along the main body, the main body having means for forming the film strip into a tubular shape within which the objects are enclosed and are fed therewith, and means for cutting the tubular film at predetermined positions between adjacent of the objects to thereby form individual packaged products, said driving system comprising:

a first driving motor adapted to be connected to the feed means for operating the feed means at a constant speed;

a second driving motor adapted to be connected to the film supply means for operating the film supply means;

a third driving motor adapted to be connected to the cutting means for operating the cutting means;

detecting means adapted to be provided adjacent the feed means for detecting the presence of each of the objects at a predetermined point on the feed means; and control means, connected to said first, second and third driving motors and to said detecting means, for controlling said second and third driving motors in such a manner that said second and third driving motors are operated for predetermined periods of time only each time said detecting means detects the presence of an object.

21. A driving system as claimed in claim 20, wherein the packaging apparatus further includes means for folding front and rear edges of the tubular film of each of the individual packaged products, and wherein said third driving motor is adapted to be connected to the folding means to operate the folding means.

22. A driving system as claimed in claim 20, wherein said control means includes means for commencing operation of said second and third driving motors at a delayed timing after the presence of an object is detected.

23. A driving system as claimed in claim 20, wherein the feed means includes a plurality of fingers arranged at regular spaced intervals for conveying respective objects, and wherein said periods of time during which said second and third drive motors are operated is controlled by said control means to be substantially equal to a period of time during which each finger moves a distance corresponding to one interval.

24. A drive system as claimed in claim 20, wherein the feed means includes a plurality of fingers arranged at regular spaced intervals for conveying respective objects, and wherein said periods of time during which said second and third drive motors are operated is controlled by said control means to be less than a period of time during which each finger moves a distance corresponding to one interval.

25. A drive system as claimed in claim 24, further comprising judging means for determining whether a member detected by said detecting means is an object to be packaged or a finger.

* * * * *